US005611530A

United States Patent [19]

Maresse et al.

[11] Patent Number: 5,611,530

[45] Date of Patent: Mar. 18, 1997

[54] DEVICE FOR THE DELIVERY OF PRINTED PRODUCTS OUT OF A FAN

[75] Inventors: Alain Maresse, Neufvy sur Aronde; Philippe Robin, Carmoisy; Didier Romanyszyn, Montataire, all of France

[73] Assignees: Heidelberger Druckmaschinen AG, Heidelberg, Germany; Heidelberg Harris Inc., Dover, N.H.

[21] Appl. No.: 422,392

[22] Filed: Apr. 14, 1995

[30] Foreign Application Priority Data

Nov. 15, 1994 [FR] France ..... 94 04512

[51] Int. Cl.[6] ..... B65H 29/20

[52] U.S. Cl. ..... 271/315; 271/187

[58] Field of Search ..... 271/72, 83, 187, 271/216, 315

[56] References Cited

U.S. PATENT DOCUMENTS

| | | | |
|---|---|---|---|
| 4,205,837 | 6/1980 | Hein et al. | 271/315 |
| 4,434,979 | 3/1984 | Kobler et al. | 271/315 |
| 4,565,363 | 1/1986 | Faltin | 271/187 |
| 4,886,260 | 12/1989 | Reist | 271/315 |
| 4,886,264 | 12/1989 | Haensch | 271/315 |
| 5,125,645 | 6/1992 | Eberle . | |
| 5,359,930 | 11/1994 | Hansen | 271/315 |

FOREIGN PATENT DOCUMENTS

| | | |
|---|---|---|
| 067399 | 12/1982 | European Pat. Off. . |
| 408902 | 1/1991 | European Pat. Off. . |

*Primary Examiner*—H. Grant Skaggs
*Attorney, Agent, or Firm*—Kenyon & Kenyon

[57] ABSTRACT

The present invention relates to a device for the delivery of products out of fans for forming a shingled product stream. The invention uses at least one endless chain lead around a drive shaft of a fan arrangement. The chain links of the chain are equally spaced from one another. The fan arrangement uses multiple fans disposed on a drive shaft in spaced relation. The invention has at least one endless chain, having chain links with a projection, and which chain is arranged between the fans. The projections of the chain links touch and guide the front edges of printed products in the pockets and, during common movement of the fans and chain, change the position of the products in the pockets of the fans.

9 Claims, 3 Drawing Sheets

DEVICE FOR THE DELIVERY OF PRINTED PRODUCTS OUT OF A FAN

BACKGROUND OF THE INVENTION

1. FIELD OF THE INVENTION

The present invention relates to a device for delivering printed products out of a fan in a folding apparatus to thereafter form a shingled product stream. The device of the present invention has at least one endless chain which is lead around a drive shaft of the fan and individual links of the chain are equally spaced from one another. The chain assists in ensuring gentle handling of the products, to thereby eliminated smearing, and also ensures an accurate and unvarying shingled product stream.

2. DESCRIPTION OF THE PRIOR ART

European Patent No. 0 059 873 shows a device for the delivery of printed products out of fans in a folding apparatus. The device in that patent has several fans arranged side-by-side on an axle. Next to each of the fans there is a disk which is eccentrically located with respect to the axle of the fans. Each disk carries a stop wheel, which is driven by inner gearing having a predetermined transmission ratio. The stop wheels rotate at a lower rotational or circumferential speed than the fans, so that the printed products moving forward and dipping into the fan pockets are decelerated before they reach the pocket bottom. As a result, the length of the fan pockets cannot be utilized in their entirety to reduce the kinetic energy inherent in the printed products.

Since there is a predetermined fixed transmission ratio between the stop wheel and the associated fan in the device described in the above patent, it is not possible to change or adjust the deceleration characteristics. Furthermore, the high manufacturing costs of the gear constructions used in this device are disadvantageous.

The second embodiment disclosed in EPO 0 059 873 uses grippers disposed on the stop wheel in the area of the stops. The grippers firmly grip the front edge of the printed products. The grippers are controlled by roller levers moved by rollers running on a stationary cam. This design requires a disproportionately high investment in mechanical equipment to implement.

In European Patent No. 0 164 440 there is disclosed a rotary delivery device for receiving newspapers at high speeds. On a central hub of the delivery device there are arranged several accurate delivery fingers which form individual pockets, into which the newspapers to be delivered enter. Close to the bottom of the pockets there are disposed spring-biased clamping bars which are pressed back by the back of a newspaper entering the pocket. Because the clamping bars are spring-biased, the back of the newspaper is clamped between the clamping bar and an adjacent delivery finger.

In the case of newspapers consisting of multiple layers, the ink absorptivity is influenced by the porous quality of the paper, especially in gravure printing. As a result, newspaper products, which are frequently printed with only one color, are relatively insensitive to smudging.

In offset printing, however, the printing material is frequently printed on both sides. Furthermore, multiple layers of ink are often applied, and the uppermost layer may not be completely cured or dried after the printed material has passed through a dryer. The printed image on such products is prone to smudging as the result of use of the clamping bars described in EPO 0 164 440. Therefore, the mechanical strain exerted on the products by this device is not favorable, and its use for the delivery of products produced in offset printing is not desirable.

European Patent No. 0 307 889 also discloses a device for the delivery of printed products out of fans from a folding apparatus. In that patent, at least one cam segment is arranged in a manner such that a chain can be lead around the drive shaft of the fan. On the chain there are arranged, at equal distances, angle and clamping pieces which can be brought into working contact with the fan blades. In this device, the products entering the fan pockets first are gripped by the angle pieces fastened to the chain, and aligned. The clamping piece acting on the products from above press the products onto the fan blade on which the products lie. Thus, the products are pressed onto the fan wheel blades during their movement out of the fan pockets. As a result, the underside of the products can be smudged or scratched, despite a teflon coating on the inside of the fan blade.

BRIEF DESCRIPTION OF THE INVENTION

In view of the disadvantages of the prior art devices discussed above, it is an object of the present invention to provide a delivery device for printed products, to deliver a shingled product stream of equally spaced overlaps. It is further an object of the present invention to provide a device which is gentle on the product material, and in which the kinematic forces of moving delivery components are used.

In the present invention, the above objects are achieved by providing:

- a fan arrangement with several fans in spaced relation;
- at least one endless chain having projecting chain links arranged between the fans;
- the projections on the chain links touching and guiding the front edges of products in the fan pockets; and
- wherein the chain links, during the common movement of the fans and the chain, continuously change the position of the products in the pockets of the fans.

The solution according to the present invention has the advantage that clamping down the products in the pockets is avoided. The products are only subjected to their own weight when pushed out of the fan pockets, and are not subjected to a force pressing them against their support, which would increase friction. Furthermore, the products received in the pockets are in contact with the projecting rims of the chain links only with their folded spine, i.e., only with their most stable part. Since the front edge of each product is supported by the projection of the respective chain link, damage to the product front edge, like bending or tearing-off, is avoided.

In order to achieve smooth delivery of the products onto transport tapes arranged below the fans, the projections of the chain links are provided with a rounded-off contour, formed for example, via a circular or involute surface. The individual fans and at least one first chain wheel of the chain are received on an axial sleeve which is adjustable with respect to a drive shaft. The axial sleeve, rotatable on the drive shaft, permits adjustment of the region of entry of the products into the individual fan pockets with respect to an exit zone B of the folding machine. Thereby, the position of the chain is simultaneously adjusted. This design also permits a change in the phase relationship between the fans and a respective first chain wheel, after a setting device has been loosened. This phase changes allows for setting the point of contact between the printed products and a chain link at different points in time, depending on entry speed and product length. It may be desirable to have smaller length printed products not enter the entire length of a pocket due to the pitch of delivery on the conveying belt.

Furthermore, a second chain wheel of the chain is adjustable with respect to the surface of a transport tape. In order to achieve this result, an arrangement receiving the second chain wheel is displaceable in a recess of a bearing arm. The respective radially inner edges of the pockets in the fans extend essentially parallel to one another. In the outer circumferential region of the fans, entry funnels are defined by the inner rim of a fan blade and the outer contour of an adjacent fan blade. These funnels permit easier entry of the products into the pockets of the fans.

The rotational speed of the transport tape, onto which the products are delivered, exceeds the rotational speed of the chain with the projections on the chain links. As a result, the front edges of the individual products are pressed against the projections of the chain links until the projections pass an exit zone A. The rounded-off contour of the chain link projections promotes this release process. Because the products already overlap each other at this point, variation in the spacing of the overlap is virtually impossible. The guidance of the products on the transport tape is maintained as long as possible.

A further advantageous feature of the device according to the present invention is that the individual chain links of the chain are connected to one another through releasable connecting elements—for example, through snap locks. In this way, the chain can be shortened or lengthened. Also, a variation of the angle of slope of the chain is possible.

BRIEF DESCRIPTION OF THE DRAWINGS

These and other characteristic features of the invention will be explained in the following description, which will be best understood when read in connection with the accompanying drawings. In the drawings.

DETAILED DESCRIPTION OF THE DRAWINGS

Figure 1:
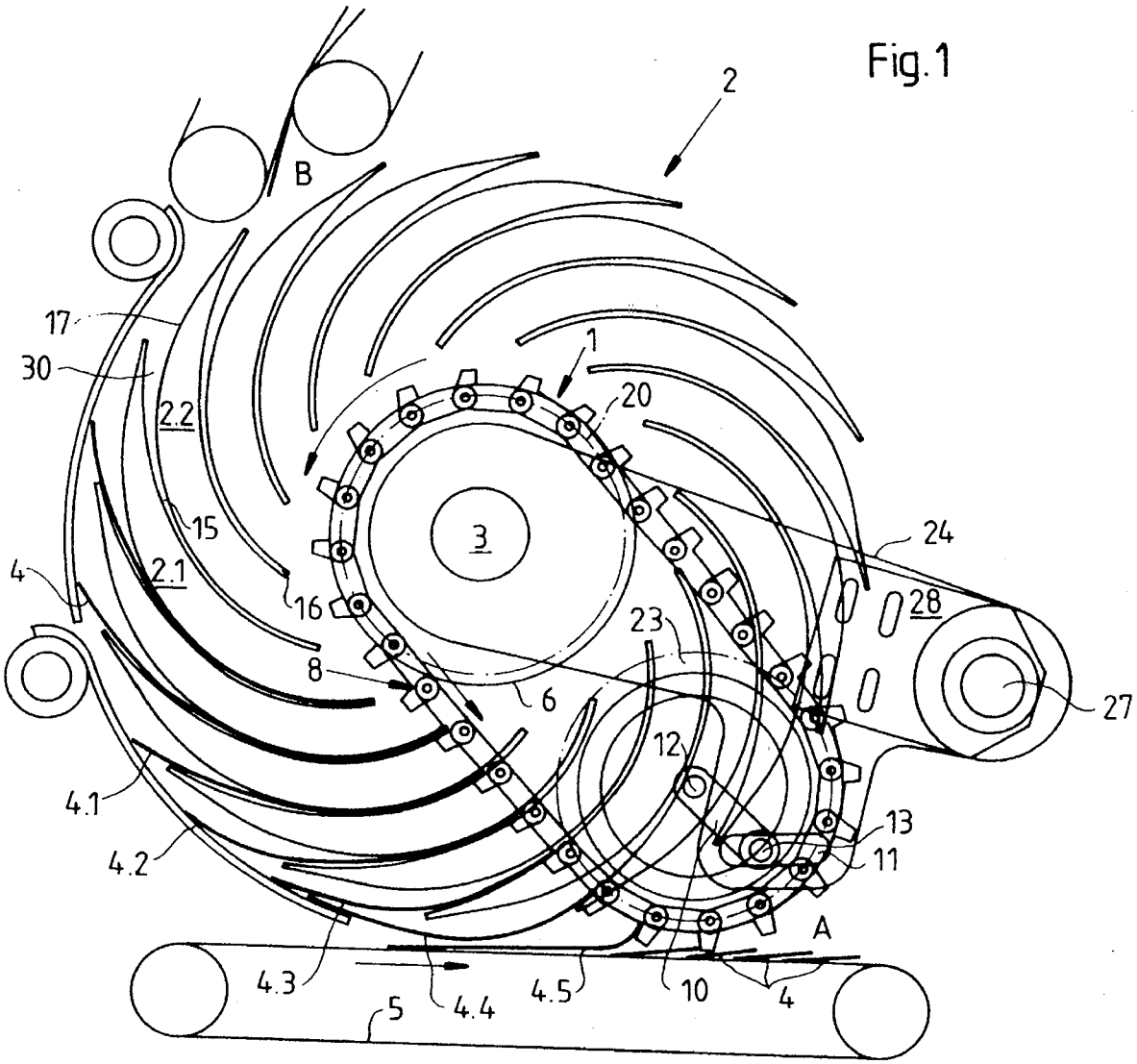
FIG. 1 is a side view of a fan of the present invention situated above a transport tape.

FIG. 1 illustrates a fan 2 with a transport tape 5 passing below. Above the fan 2 there is an exit zone B of a folding machine, from which printed products 4 from a folding machine are fed into fan 2. Below the fan 2, and above the transport tape 5, there is an exit zone A. The fan 2 is driven by a drive shaft 3, and a first chain wheel 6 of a chain 1 is mounted on the drive shaft 3. The chain 1 consists of chain links 20 connected to one another in an articulated manner. Each of the chain links 20 has a projection with a contoured guide surface 8 (see FIG. 3). The chain 1 also rotates around a second chain wheel 23 which is mounted on a shaft 12 held on a lever 10. An axle 13 mounted in the lever 10 is horizontally movable in a longitudinal recess 11 of a bearing arm 24. After loosening a safety disk 14, the axle 13 in the recess 11 is slidable, allowing adjustment of wheel 23 depending on the length of the chain 1.

The recess 11 is in the lower part of the bearing arm 24 through which an axle 27 extends. On axle 27 there is mounted a further bearing arm 24 (shown in FIG. 2). The axle 27 is held in a side wall 29 of the folding apparatus by means of an adjusting flange 28.

In the fan 2 a pocket 30 is formed by the fan blades 2.1 and 2.2. The inner contour 15 of the fan blade 2.1 and the outer contour 17 of the fan blade 2.2 define an entry funnel which promotes the entry of the products 4 into the individual pockets 30. The shape of the pockets 30 as defined by their inner contour 15 and their outer contour 17 effects a slowing down of the products 4 before they hit the pocket bottom 16, and the pockets 30 are generally spiral in shape. By rotating the fans 2 in the direction of the arrow shown in FIG. 1, the front edge of each product 4 moves from above against the projection of a chain link 20. Thus, the front edge of the product 4 is caught and supported by the projection. The downward movement of the chain 1, along with rotation of the respective fan 2 causes the product 4.1 to be pushed out of the fan pocket 30 at the same time as that the products 4.2 and 4.3 are being pushed out much farther and the product 4.4 is just about to leave the fan 2 and overlap the product 4.5 already lying on the transport tape 5. Through the somewhat higher speed of the rotating transport tape 5 with respect to the rotary speed of the chain links 20 of the chain 1, the product 4.5 continues to be held against the angled projection of the chain link 20, which forms a guide surface 8. The product 4.5 is held against the guide surface 8 until it has largely been overlapped by the product 4.4. Only then does the projection of the chain link 20 guiding the product 4.5 move out of the exit zone A and release the front edge of the product 4.5.

Thus, the release of each product 4 to be delivered takes place only after it is largely overlapped by a subsequent product 4. Therefore, the spacing of the overlap does not vary, so that high overlap accuracy of the shingled product stream can be achieved.

By adjustment of the respective second chain wheels 23, the projections of the chain links 20 of the chain 1 can be engaged with the upper side of the transport tape 5. After loosening a respective safety disk 14 (see FIG. 2) the axle 13 in the recess 11 of the bearing arm 24 may be horizontally displaced. Thereby, the lever 10, by which the shaft 12 bearing the second chain wheel 23 is mounted, takes an inclined position. This enables retightening of the chain 1 and enables the span of time which the projections of the chain links 20 require to remain in the exit zone A to be prolonged. This prolongation may be necessary when the conveying speed of tape 5 does not match the rotational speed of the fan wheel. Thus, the delivery conditions for products consisting of thin material and with only a few pages can be markedly improved.

Figure 2:
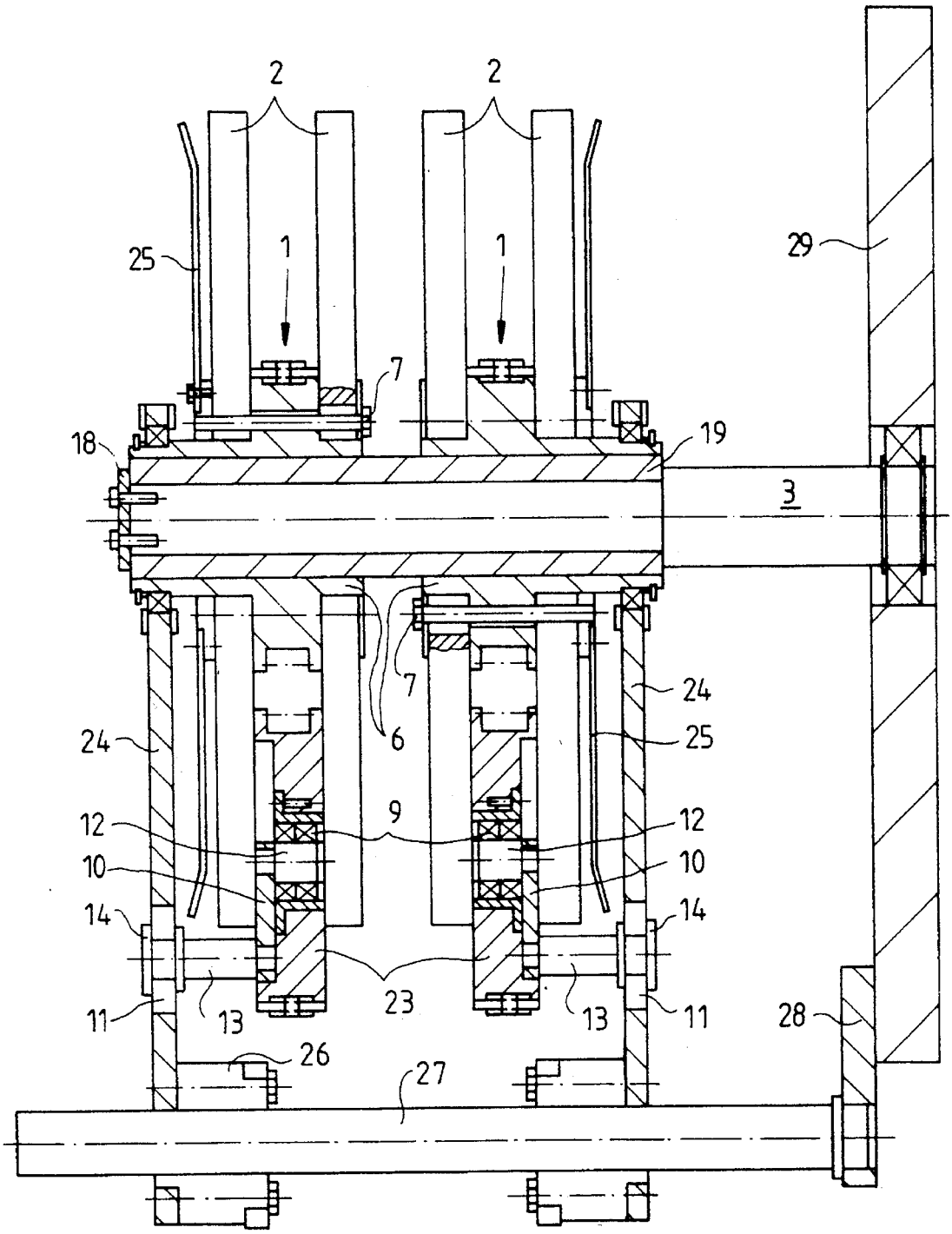
FIG. 2 is a top view of the chains of the present invention arranged between the fans.

FIG. 2 illustrates a top view of the present invention. The drive shaft 3 is mounted in a side wall 29 of the folding apparatus. In the side wall 29 there is also an adjusting flange 28 which supports one end of the axle 27. The bearing arms 24 are held at one end in bearings 26 on the axle 27 and at an opposite end are held in roller bearings on an axial sleeve 19, rotatably mounted on the drive shaft 3. In order for the axial sleeve 19 to turn, screws on disk 18 must be loosened. As a result, turning of the fans 2 including the first chain wheels 6 can take place, in order to influence, for example, the entry angle of the products 4 into the pockets 30 in the exit zone B of the folding machine (see FIG. 1).

The first chain wheels 6 are each connected to two fans 2 around which the chains 1 rotate. A screw 7 extends through the fan vane wheels 2 and the respective first chain wheels 6. If screw 7 is loosened, the phase relationship between the respective first chain wheels 6, and as a result chain 1,and the position of the fans 2 can be adjusted.

Two product guides 25 are mounted on the circumference of the axial sleeve 19. The second chain wheels 23 are held in roller bearings 9 on short shafts 12 which, in turn, are connected via a lever 10 with axles 13, which are horizontally slidable in recesses 11. For displacement of the second chain wheels 23 the safety disks 14 merely have to be loosened and locked again after the displacement has been completed.

Figure 3:
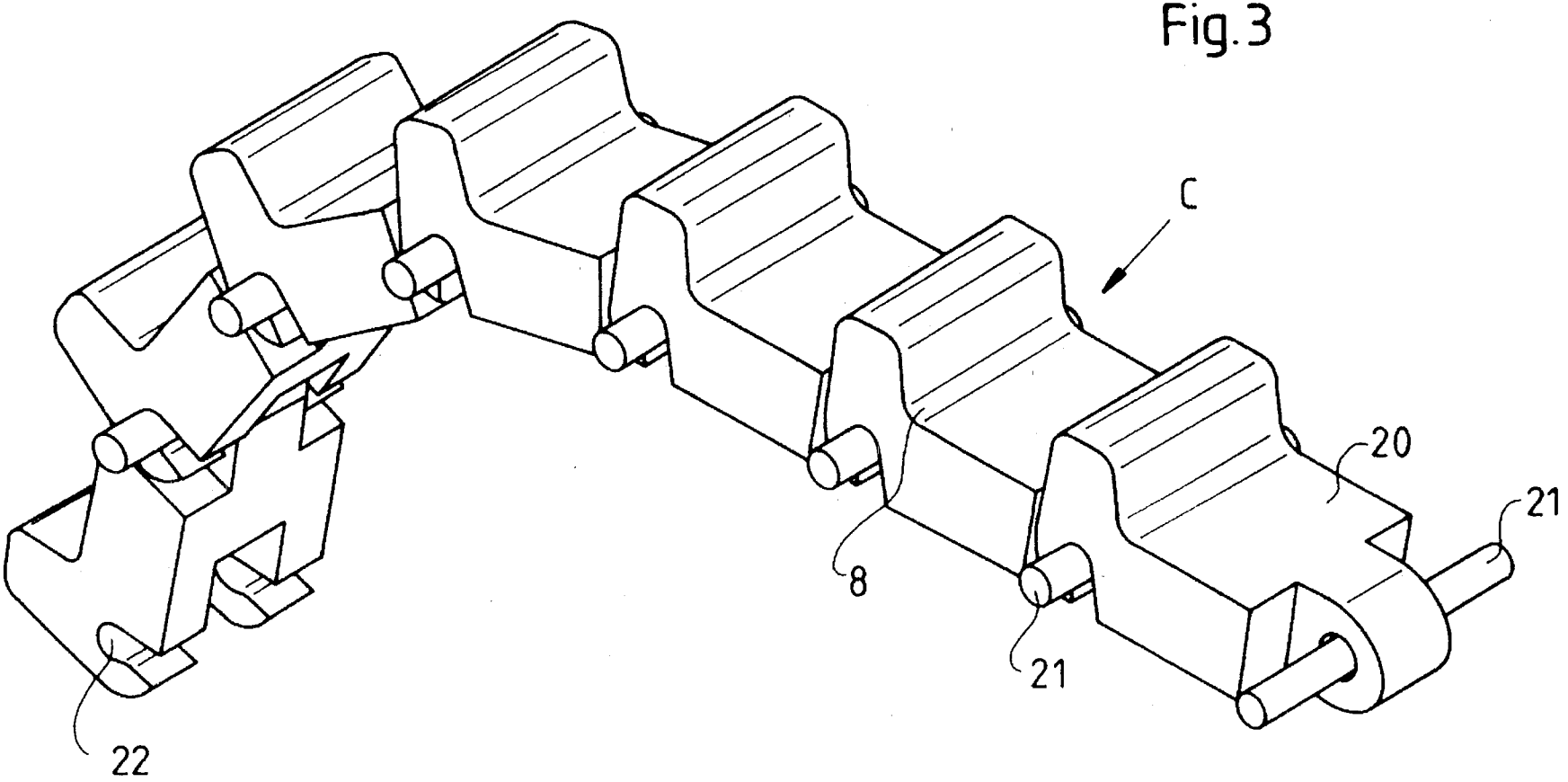
FIG. 3 is a perspective rear view of chain links of the present invention connected to one another.

FIG. 3 is a perspective view of the connected chain links 20 and illustrates the rounded-off contour C of the projection of each chain link 20, which facilitates the release of the products 4. Each of the chain links 20 is provided with a recess 22 through which a linch pin 21 is pushed for connecting the individual chain links 20 to one another. When the recesses 22 are designed as snap locks—as illustrated herein—the chain 1 can be shortened or lengthened as desired. As a result, the angle of slope of the projections of the chain links 20 with respect to the products 4 received in the pockets 30 can be varied. Precise adjustment of the shortened or lengthened chain 1 is ensured by the displaceable arrangement (lever 10, shaft 12, axle 13) bearing the second chain wheel 23.

The individual chain links 20 can be manufactured in a simple and inexpensive way; the snap locks formed by the linch pin, 21 and the recess 22 enable easy assembly and disassembly of the chain 1.

We claim:

1. A device for delivering printed products to thereby form a shingled product stream, comprising:

a drive shaft;

at least one rotatable fan arrangement mounted on said drive shaft, said fan arrangement comprising fan blades in spaced relation to one another, said fan blades forming fan pockets;

at least one endless chain rotating with said fan arrangement, said chain comprising equally spaced individual chain links, said chain links comprising projections arranged between said fan blades, said projections touching and guiding a front edge of said products when said products are in said fan pockets; and a first chain wheel, said fan blades being connected to said first chain wheel by an adjusting device;

wherein said chain links, during rotational movement of said fan blades, change a position of said products in said pockets of said fan arrangement.

2. The device of claim 1, wherein said projections have a rounded-off contour.

3. The device of claim 1, wherein radially inner contours of said pockets extend essentially parallel to one another.

4. The device of claim 1, wherein said fan blades comprise first and second fan blades adjacent one another, and wherein an entry funnel is formed in an outer circumferential region of said fan arrangement, said entry funnel being formed between an inner contour said first fan blade and an outer contour of said second fan blade.

5. The device in claim 1, further comprising a transport tape, and wherein a rotational speed of said transport tape exceeds a rotational speed of said projections.

6. A device for delivering printed products to thereby form a shingled product stream, comprising:

a drive shaft;

at least one rotatable fan arrangement mounted on said drive shaft, said fan arrangement comprising fan blades in spaced relation to one another, said fan blades forming fan pockets;

at least one endless chain rotating with said fan arrangement, said chain comprising equally spaced individual chain links, said chain links comprising projections arranged between said fan blades, said projections touching and guiding a front edge of said products when said products are in said fan pockets; and a first chain wheel and an axial sleeve, said fan arrangement and said first chain wheel being mounted on said axial sleeve, said axial sleeve being adjustable with respect to said drive shaft;

wherein said chain links, during rotational movement of said fan blades, change a position of said products in said pockets of said fan arrangement.

7. The device of claim 6, wherein a circumferential position of said first chain wheel is adjustable with respect to a position of said fan blades, to thereby change the phase relationship between said chain and said fan arrangement.

8. The device of claim 6, further comprising a second chain wheel and a transport tape, wherein a position of said second chain wheel is adjustable with respect to a surface of said transport tape.

9. The device of claim 8, further comprising bearing arms, and wherein an apparatus upon which said second chain wheel is mounted is slidable in recesses of said bearing arms.

* * * * *